US005950248A

United States Patent [19]

Kawashima et al.

[11] Patent Number: 5,950,248

[45] Date of Patent: Sep. 14, 1999

[54] SWIMMING GOGGLES

[75] Inventors: Haruo Kawashima; Shunji Fukasawa, both of Tokyo, Japan

[73] Assignee: Tabata Co., Ltd., Tokyo, Japan

[21] Appl. No.: 09/022,887

[22] Filed: Feb. 12, 1998

[30] Foreign Application Priority Data

Feb. 12, 1997 [JP] Japan ..... 9-028151

[51] Int. Cl.[6] ..... A61F 9/02

[52] U.S. Cl. ..... 2/441; 2/426; 2/428; 2/440; 2/443; 2/445; 2/452

[58] Field of Search ..... 2/426, 428, 427, 2/430, 431, 432, 433, 440, 441, 445, 434–439, 442–444, 446–454

[56] References Cited

U.S. PATENT DOCUMENTS

| | | | |
|---|---|---|---|
| 4,755,040 | 7/1988 | Haslbeck | 2/428 |
| 5,093,940 | 3/1992 | Nishiyama | 2/441 |
| 5,459,882 | 10/1995 | Yamamoto | 2/428 |
| 5,524,300 | 6/1996 | Chiang | 2/439 |
| 5,631,716 | 5/1997 | Chao | 2/426 |
| 5,682,621 | 11/1997 | Park | 2/441 |

FOREIGN PATENT DOCUMENTS

| | | |
|---|---|---|
| 6-5818 | 2/1994 | Japan . |
| 6-48715 | 7/1994 | Japan . |
| 7-17327 | 4/1995 | Japan . |

*Primary Examiner*—John J. Calvert
*Assistant Examiner*—Tejash D Patel
*Attorney, Agent, or Firm*—Lowe Hauptman Gopstein Gilman & Berner

[57] ABSTRACT

Each lens member 1 of swimming goggles includes an annular peripheral wall 12 extending rearward from a peripheral edge of a front lens portion of the lens member 1 and a flange 13 formed on a rear end of the peripheral wall 12. The peripheral wall 12 is partially formed with a wall surface portion 14 spaced from a front surface of the flange 13 to define a second groove 16 therebetween and the front surface of the flange 13 is formed with a first groove 19. Each of pad members 2 presents an annular configuration and is formed with a first wall 22 and a first projection 26 adapted to be received by the second groove 16 and the first groove 19 respectively.

4 Claims, 2 Drawing Sheets

SWIMMING GOGGLES

BACKGROUND OF THE INVENTION

This invention relates to swimming goggles used during swimming.

A means to prevent pad members of swimming goggles from unintentionally falling off during use is well known. For example, Japanese Utility Model Publication No. 1994-5818 discloses swimming goggles in which a body frame of the goggles is formed with a flange-like projection adapted to be engage a groove formed along inner peripheral edges of a pad member.

Japanese Utility Model Publication No. 1995-17327 discloses swimming goggles in which a peripheral flange of a body frame engage a first groove formed in a pad member and a rib formed in the first groove engages with a second groove formed in the peripheral flange.

Japanese Utility Model Laid-Open Application No. 1994-48715 discloses an eye-cup in which a peripheral wall extends rearward from a peripheral edge of a lens member and the peripheral wall is formed around its rear end with a circumferential groove. A front end of an eye-pad engages with the circumferential groove and a wall section defining a rear surface of the circumferential groove engages with a circumferential groove formed along an inner peripheral surface of the eye-pad in proximity of its front end.

The swimming goggles disclosed by Japanese Utility Model Publication No. 1994-5818 is disadvantageous in that the pad member is apt to fall off from the flange-like projection as the pad member is deformed radially outward of the lens member. This a tendency becomes pronounced as the goggles are miniaturized and flange width decreases.

The swimming goggles disclosed by Japanese Utility Model Publication No. 1995-17327 is effective to prevent the pad member from being undesirably deformed and falling off by forming the pad member with the rib adapted to be engaged with the second groove formed in the flange. However, the pad member becomes liable to fall off from the flange as flange width decreases, as in the previously mentioned prior art example.

The eye-cup disclosed by Japanese Utility Model Laid-Open Application No. 1994-48715 is advantageous in that the front end of the pad member is protected against direct touch of a swimmer's hand. Therefore, the pad member is prevented from being deformed radially outward and falling off from the flange. However, the pad member is likely to fall off from the flange as the rear end of the pad member is pulled rearward as in the previously mentioned two prior art examples.

In all cases as have been described above, a desired water-tight property of the goggles is spoiled when the pad member is unintentionally moved out of place relative to the lens member.

SUMMARY OF THE INVENTION

In view of problems described above, it is a principal object of the invention to provide swimming goggles so improved that a pad member is reliably prevented from slipping out of place relative to a lens member and/or falling off from the lens member and thereby a desired water-tight property of the goggles is assured.

The object set forth above is achieved, according to the invention, by swimming goggles comprising at least a pair of lens members, a pair of annular pad members respectively mounted on rear ends of the lens members and a holder band adapted to be worn around a swimmer's head. Each of the lens members includes an annular peripheral wall extending rearward from a peripheral edge of a front lens portion and a flange extending outward from a rear end of the peripheral wall. An outer side of the peripheral wall is partially formed with a wall surface portion extending circumferentially of the outer side so as to be opposed to and spaced from a front surface of the flange by a desired distance. The flange is formed with a first groove extending along its portion not in face-to-face relationship with the wall surface portion and recessed from a front surface toward a rear surface of the flange. Each of the annular pad members is formed with a first wall section adjacent a front side and a second wall section adjacent a rear side of the pad member. Both wall sections extend parallel to each other circumferentially of the pad member to define a second groove therebetween destined to receive the flange. The first wall section is partially formed with a projection rising toward the second wall section and the projection is detachably engaged with the first groove formed in the flange.

Preferably, there are provided annular members each adapted to cover the pad member at least over an extent including a region in which the projection is engaged with the first groove, a region in which the flange is engaged with the second groove and regions defined adjacent these regions of engagement so as to be detachably snap-locked with the lens member from the front side thereof. Such an annular member cooperates with the flange to hold the front end of the pad member therebetween.

DESCRIPTION OF THE PREFERRED EMBODIMENT

Figure 1:
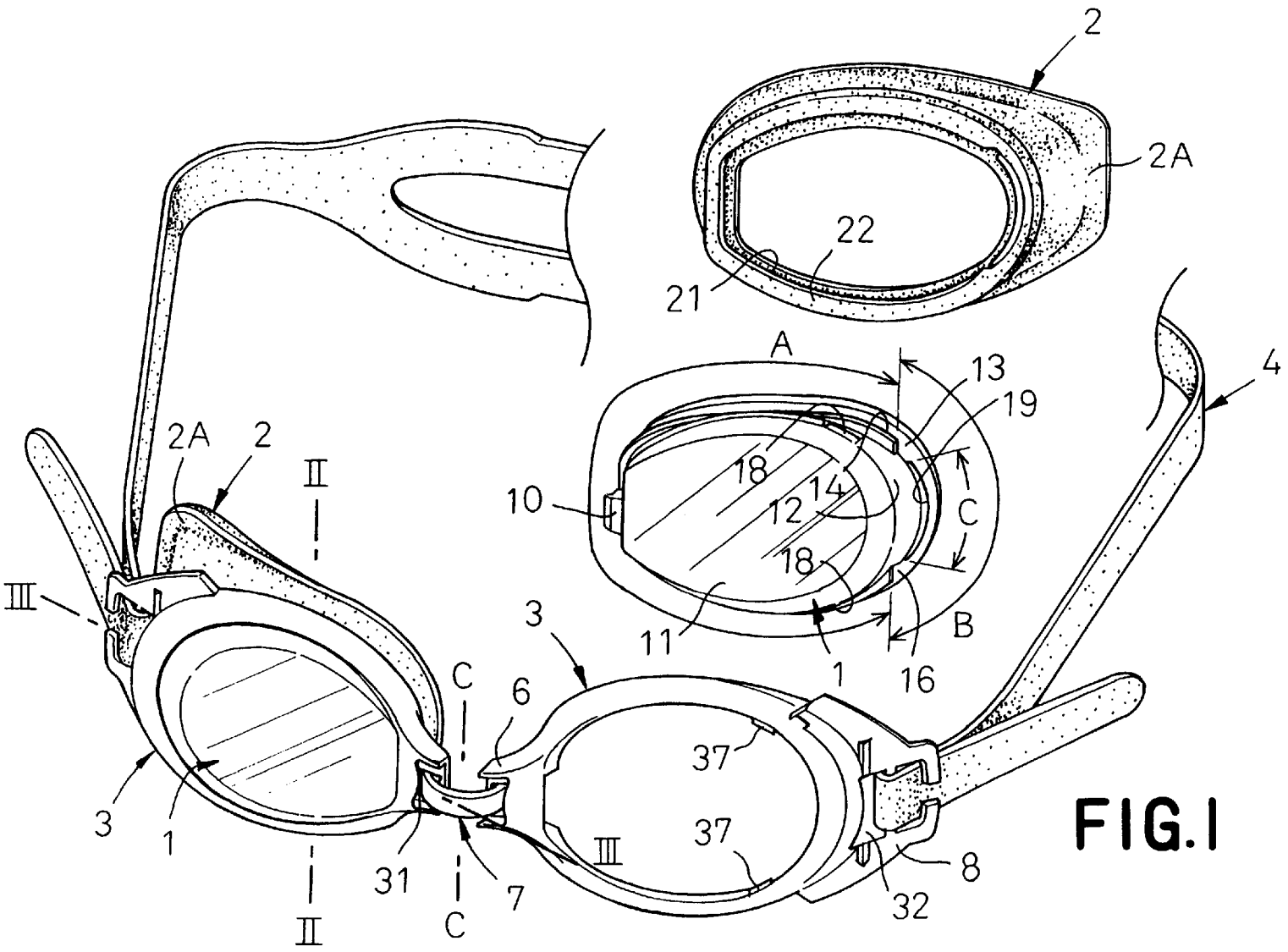
FIG. 1 is a partially exploded of perspective view swimming goggles according to the invention.

Referring to FIG. 1, a part corresponding to the right eye is illustrated in an assembled state while a part corresponding to the left eye of a swimmer is illustrated as being exploded, and a holder band 4 is illustrated as partially broken away.

The goggles comprise a pair of lens members 1, a pad member 2 adapted to be pressed against the swimmer's face and a pair of annular frame members 3 snap-locked from the front with the lens members 1. The pair of frame members 3 have their inner ends 6 opposed to each other in proximity of the middle of the user's face and their outer ends 8 opposed to the inner ends. The inner ends 6 are connected to each other by a bridge belt 7 and the outer ends 6 are connected to each other by the holder band 4.

Figure 3:
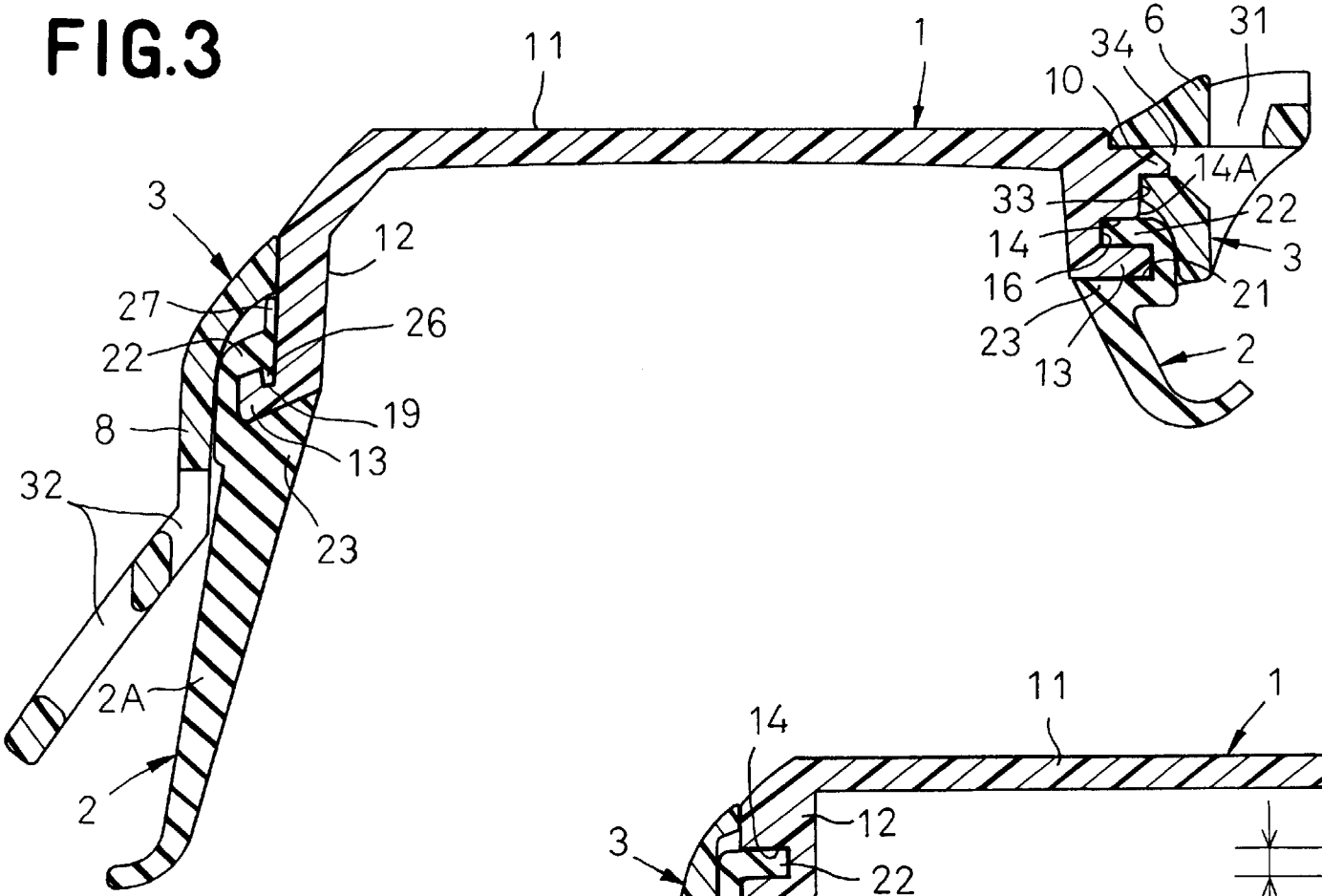
FIG. 3 is a sectional view taken along line III—III in FIG. 1.
Figure 2:
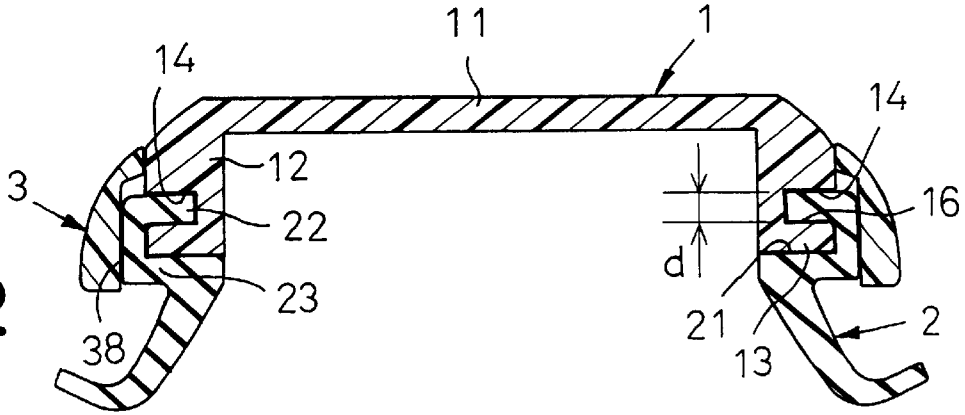
FIG. 2 is a sectional view taken along line II—II in FIG. 1.

FIGS. 2 and 3 are sectional views taken along lines II—II and III—III in FIG. 1, respectively, and illustration of the band 4 and the belt 7 are eliminated in FIG. 3.

Referring to FIGS. 1, 2 and 3, the lens members 1 are molded pieces of transparent hard plastic material and each of these lens members comprises a front lens portion 11, an annular peripheral wall 12 extending rearward from a peripheral edge of the lens portion 11, and a flange 13 extending radially outward from a rear edge of the peripheral wall 12.

The peripheral wall 12 is formed at its inner end with a first locking lug 10 extending toward a vertical centerline C—C of the goggles and includes a wall surface portion 14 extending from the inner end to an outer end of the peripheral wall 12 so as to be opposed to and spaced from the flange 13 by a distance d (FIG. 2). This wall surface portion 14 extends only along a partial extent A (FIG. 1) and not along the remaining extent B circumferentially of the peripheral wall 12. A front surface of the flange 13 and the wall surface portion 14 opposed to the front surface define therebetween a second groove 16 recessed radially inward of the peripheral wall 12. Preferably, the flange 13 extends outward beyond a peripheral edge 14A of the wall surface portion 14 radially of the peripheral wall 12 at least along a portion of the entire circumference of the peripheral wall 12. Such a relationship between the extending flange 13 and the edge 14A will be apparent from FIG. 3 which illustrates details of the flange 13 and the wall surface portion 14 together with the inner end 6 of the annular frame member 3.

Referring to FIG. 1, the peripheral wall 12 is additionally formed along portions in proximity of its outer end with a pair of upper and lower grooves 18 recessed in the direction of the peripheral wall's thickness. The flange 13 is formed in its front surface with a first groove 19 recessed from the front surface toward the rear surface of the flange 13 and extending circumferentially of the peripheral wall 12 along an extent B of the flange 13 or a portion C of the extent B. None of these extent B and portion C is face-to-face with the wall surface portion 14 of the peripheral wall 12.

The pad member 2 is an annular molded piece of soft elastic material such as rubber and gradually flares from its front end toward its rear end destined to be pressed against the swimmer's face. The inner peripheral surface of the pad member 2 is formed in the proximity of its front end with a third groove 21 extending circumferentially thereof to receive the flange 13 of the lens member 1. The third groove 21 is defined by a first or front wall section 22 and a second or rear wall section 23 cooperating to hold the flange 13 therebetween from front and rear sides. The first wall section 22 is inserted into-the second groove 16 along the extent A (FIG. 1) of the lens member 1. Along the extent B of the lens member 1, a first projection 26 extends from an inner (i.e., rear) surface of the first wall section 22 toward an inner (i.e., front) surface of the second wall section 23 while a second projection 27 extends from an outer (i.e., front) surface of the first wall section 22 in the direction opposite the direction the first projection 26 extends. The first and second projections 26, 27 extend also circumferentially of the peripheral wall 12 and the first projection 26 is received by the first groove 19 formed in the front surface of the flange 13. Engagement of the third groove 21 with the entire periphery of the flange 13, insertion of the first wall section 22 into the second groove 16 and engagement of the first projection 26 with the first groove 19 reliably prevent the pad member 2 from moving not only back or forth but also radially outward relatively to the lens member 1. In this manner, the pad member 2 cannot easily fall off from the lens member 1. With the goggles provided with the pad member 2 of which a relatively long outer end portion 2A extends rearward, as in the specific embodiment shown by FIG. 3, it has conventionally been almost inevitable that the pad member 2 may easily fall off from the flange 13 as the outer end portion 2A is pulled rearward. According to the invention, however, the first projection 26 is tightly engaged with the first groove 19 to eliminate unintentional falling off.

The annular frame member 3 is a molded piece of hard plastic material and formed in the proximity of its inner end 6 and its outer end 8 with an insertion hole 31 for the bridge belt 7 and an insertion hole 32 for the holder band 4, respectively. The annular frame member 3 is additionally formed in the proximity of the inner end with a hole 34 extending horizontally through the annular frame member 3 from its inner surface to its outer surface so that the first locking lug 10 formed on the lens member 1 in proximity of its inner end may be detachably received by the hole 34 (FIG. 3). An inner peripheral surface of the annular frame member 3 is formed in proximity of its outer end 8 with a pair of vertically opposed second locking lugs 37 adapted to be detachably snap-locked with the corresponding pair of vertically opposed recesses 18 of the lens member 1 (FIG. 1). To assemble frame member 3 with the lens member 1, first locking lug 10 of the lens member 1 which has already been assembled with the pad member 2 may be brought into engagement with the hole 34 of the frame member 3 followed by snap-locking the second locking lugs 37 with the respective 18. With the goggles having been assembled in this manner, the inner surface of the frame member 3 lies closely adjacent the outer surface 38 of the pad member 2 as viewed in the sectional plane of FIG. 2 or is lightly pressing against the outer surface 38 of the pad member 2 to prevent slipping out or even falling off of the pad member 2 from the lens member 1. In the sectional plane of FIG. 3, the inner surface of the frame member 3 in proximity of its inner end 6 lies closely adjacent or is pressing against the pad member 2 and the inner surface of the frame member 3 in proximity of its outer end 8 is pressing against the second projection 27 of the pad member 2. The second projection 27 of the pad member 2 functions to prevent the first projection 26 from disengaging from the first groove 19 of the lens member 1. As will be apparent from FIG. 3, the frame member 3 and the flange 13 hold therebetween the inner and outer ends of the pad member 2 respectively and thereby reliably prevent slipping out and/or falling off of the pad member 2.

After the above goggles worn by the swimmer, the frame member 3 is pressing against the pad member 2 sufficiently to stabilize the latter under a tension generated in the holder band 4 as the latter is inserted into the hole 32 of the frame member 3 and tightened around the swimmer's head. In addition, whether the goggles are in use or not, there is less possibility that the pad member 2 might be moved off the lens member 1 by a shock due to a slight contact with the swimmer's hand or other objects, because the pad member 2 is covered with the frame member 3 from the front side.

While the invention may be implemented without use of the frame member 3, it is preferred to apply the frame member 3 to the lens member 1. While the frame member 3 may be arranged so as to cover only the front end of the pad member 2, the frame member 3 is preferably adapted to cooperate with the flange 13 to avoid an undesirable movement of the member 2. More preferably, the inner and outer ends 6, 8 of the frame member 3 are arranged to eliminate the possibility of such an undesirable movement of the member 12.

The swimming goggles according to the invention allow the pad member to be reliably held on the lens member, since the pad member cannot move back or forth as well as radially outward relatively to the lens member once the pad member has been assembled with the lens member. Particularly when the goggles are implemented in the manner that the front end of the pad member is covered with the frame member which is, in turn, attached to the lens member from the front side, slipping out and/or falling off of the pad member can be more effectively prevented and thereby the goggles can be effectively maintained in a water-tight condition.

What is claimed is:

1. Swimming goggles comprising a pair of lens members, a pair of annular pad members respectively mounted on rear ends of the lens members and a holder band adapted to be worn around a swimmer's head; wherein:

each of the lens members includes an annular peripheral wall extending rearward from a peripheral edge of a front lens portion and a flange extending outward from a rear end of the peripheral wall radially of the peripheral wall, wherein an outer side of the peripheral wall is partially formed with a wall surface portion extending circumferentially of the outer side so as to be opposed to and spaced from a front surface of the flange by a desired distance and wherein the flange is formed with a first groove extending along its portion not in face to face relationship with the wall surface portion; and each of said annular pad members is formed with a first wall section and a second wall section adjacent a rear side of this pad member, both of which wall sections are extending in parallel to each other circumferentially of the pad member so as to define another groove therebetween destined to receive the flange, wherein the first wall section is partially formed with a projection extending toward the second wall section and said projection is detachably engaged with the first groove formed in the flange; wherein the flange extends radially outward of the peripheral wall beyond a periphery of the wall surface portion of the lens member opposed to the flange at least along a circumferential portion of the wall surface portion so the a front end of the pad member may be held between the flange and an annular frame member surrounding the flange.

2. A swimming goggles, comprising:

a pair of lens members;

a pair of annular pad members;

a pair of annular frame members;

each lens member including an annular peripheral wall which extends rearward from a peripheral edge of a front lens portion and a flange which extends radially outward from a rear end of said peripheral wall, an outer side of said peripheral wall being partially formed with a wall surface portion which extends circumferentially of said outer side so as to be opposed to and spaced from a front surface of said flange by a predetermined distance, said flange being formed with a first groove extending along a portion of said flange that is not in face-to-face relationship with said wall surface portion;

each of said pad members being formed with a front wall section and a rear wall section, said front and rear wall sections extend in parallel to each other circumferentially of said pad member so as to define another groove between said front and rear wall sections to receive said flange, said front wall section being partially formed with a projection extending toward said rear wall section, said projection being engaged with said first groove; and each of said frame members being snap-locked with said lens member from a front side of said lens member covering said pad member at least over an extent which includes a region in which said projection is engaged with said first groove, a region in which said flange is engaged with said another groove and regions defined adjacent said regions of engagement so as to be snap-locked with said lens member.

3. The swimming goggles according to claim 2, wherein said frame member snap-locked with said lens member at least partially lies closely adjacent said pad member so as to restrict a movement of said pad member in proximity of said peripheral wall of said lens member.

4. The swimming goggles according to claim 2, wherein said flange extends outward radially of said peripheral wall beyond a periphery of said wall surface portion of said lens member opposed of said wall surface portion so that a front end of said pad member may be held between said flange and said frame member.

* * * * *